US006082896A

United States Patent [19]

Pulli

[11] Patent Number: 6,082,896

[45] Date of Patent: Jul. 4, 2000

[54] COLLAPSIBLE CONTAINER FOR A BEER OR SODA KEG

[76] Inventor: Brett F. Pulli, 1651 Limekiln Pike, Dresher, Pa. 19025

[21] Appl. No.: 09/019,319

[22] Filed: Feb. 5, 1998

[51] Int. Cl.[7] ..... B65D 33/06; B65D 30/08; F25D 3/08

[52] U.S. Cl. ..... 383/6; 383/110; 62/372

[58] Field of Search ..... 383/6, 110; 62/372

[56] References Cited

U.S. PATENT DOCUMENTS

| | | | |
|---|---|---|---|
| 1,949,677 | 3/1934 | Crawford | 383/110 X |
| 2,575,893 | 11/1951 | Seaman | 383/110 X |
| 4,468,933 | 9/1984 | Christopher | 383/110 X |
| 4,759,077 | 7/1988 | Leslie | 383/18 |
| 4,802,344 | 2/1989 | Livingston et al. | 62/372 |
| 4,963,175 | 10/1990 | Place | 62/372 |
| 5,251,460 | 10/1993 | DeMarco et al. | 62/371 |
| 5,564,568 | 10/1996 | Rankin, Sr. | 62/372 X |
| 5,609,265 | 3/1997 | Haberkorn et al. | 220/421 |

*Primary Examiner*—Jes F. Pascua
*Attorney, Agent, or Firm*—Klehr Harrison Harvey Branzburg & Ellers, L.L.P

[57] ABSTRACT

A thermally insulated portable container for carrying and storing a beverage keg comprising: a hollow flexible outer cover member having an open top and portion, cylindrical slidable portion and a circular bottom wall; a flexible thermal insulating material operatively disposed within said side portion; a support member coaxially positioned in the lower end portion of the internal cavity, said support member being formed from a relatively rigid thermal insulating material and adapted to support bottom end of a beverage keg; carrying means firmly secured to the outer surface and surrounding the support member, said handle means operatively to associated and adapted to be grasped and lifted by a person carrying the cooler; a thermally insulated lid means moveably secured to the top end portion for selectively opening and closing the same; fastening means for releasably holding said lid means in a closed position; and a cup sleeve member attached to the exterior of the unit.

4 Claims, 4 Drawing Sheets

COLLAPSIBLE CONTAINER FOR A BEER OR SODA KEG

FIELD OF THE INVENTION

The present invention is directed to a container for beverage kegs and the like. In particular, the present invention is directed to a collapsible container for a beer or soda keg and the like.

BACKGROUND OF THE INVENTION

The present invention is directed to containers for holding beer and soda kegs and the like. Thermally insulated coolers for enclosing a beverage keg have been known in the prior art for a number of years. U.S. Pat. No. 4,802,344 discloses a thermally insulated cooler for enclosing a beverage keg having a pre-chilled beverage temperature to be maintained. The cooler is a soft-sided composition cylindrical in shape having a closed bottom end and a removable lid zippered at the other end for affording access to the storage compartment.

U.S. Pat. No. 4,759,077 discloses a collapsible insulated carrier device for transporting a single large container of a cold beverage such as a keg of beer. The carrier is a multi-layered construction having an internally disposed thermally insulated shell fabricated of closed-cell resilient polymer, a stress-bearing harness disposed above the exterior of the shell and an outer jacket of strong thin fabric that encompasses the shell and harness. The device includes carrying handles sewn through the jacket and into engagement with the harness.

U.S. Design Pat. No. 273,833 discloses an ornamental design for an insulated pouch for beer kegs as shown and described. U.S. Pat. No. 4,514,993 discloses a barrel cooler comprising a cylindrical, open-ended insulated cloth sleeve or jacket that slips over a beer keg or the like to keep the barrel cold. The insulated cloth sleeve is fabricated from a single piece of fabric by folding the fabric in thirds longitudinally with the insulation layer there between and then stitching the bottom circumferentially.

U.S. Pat. No. 5,595,320 discloses an insulated bag having a hollow enclosing wall and one open and one covered end. The enclosing wall and the covered end include a multi-layered structure made of an inner layer of heat-resistant material, an intermediate layer, filled with air, other flexible heat insulating material and an outer layer of a metalized polyethylene material.

While there are a number of keg cooler bags and related vessels, it would be desirable to provide a beer keg container which could be quickly set up and collapsed and easily transported. It would also be desirable to provide a beer keg container having a cup sleeve holder. It would be desirable to provide a beer keg container which can be quickly inverted and cleaned.

In accordance with the present invention, a thermally insulated portable container for carrying and storing a beverage keg is disclosed. In a preferred embodiment, the container comprises a hollow flexible outer cover member having an open top and portion, cylindrical slidable portion defining an internal cavity and a circular bottom wall; a flexible thermal insulating material operatively disposed within said side portion; a support member coaxially positioned in the lower end portion of the internal cavity, said support member being formed from a relatively rigid thermal insulating material and adapted to support bottom end of a beverage keg; carrying means firmly secured to the outer surface and surrounding the support member, said handle means operatively associated and adapted to be grasped and lifted by a person carrying the cooler; a thermally insulated lid means moveably secured to the top end portion for selectively opening and closing the same; fastening means for releasably holding said lid means in a closed position; cup sleeve member attached to the exterior of the unit.

In yet a further embodiment, a thermally insulated portable container for carrying and storing a beverage keg includes a hollow flexible outer cover member having an open top end portion, cylindrical slidable portion defining an internal cavity and having a circular bottom wall; a flexible thermal insulating material operatively disposed within said side portion; a support a member coaxially positioned in the lower end portion of the internal cavity, said support member being formed from a relatively rigid thermal insulating material and adapted to support bottom end of a beverage keg; carrying means firmly secured to the outer surface and surrounding the support member, said handle means operatively associated and adapted to be grasped and lifted by a person carrying the container; a thermally insulated lid means moveably secured to the top end portion for selectively opening and closing the same; fastening means for releasably holding said lid means in a closed and retracted position; and a cup sleeve member attached to the exterior of the unit.

In still a further embodiment, a thermally insulated portable container for carrying and storing a beverage keg includes a hollow flexible outer cover member having end open top and portion, cylindrical slidable portion defining an internal cavity and having a circular bottom wall; a flexible thermal insulating material comprising Hollofill operatively disposed within said side portion; a support member coaxially positioned in the lower end portion of the internal cavity, said support member being formed from a relatively rigid thermal insulating material and adapted to support a bottom end of a beverage keg; carrying means firmly secured to the outer surface and surrounding the support member, said carrying means operatively associated and adapted to be grasped and lifted by a person carrying the container; a thermally insulated lid means moveably secured to the top end portion for selectively opening and closing the same; fastening means for releasably holding said lid means in a closed and retracted position; and a cup sleeve member attached to the exterior of the unit.

These and other objects of the present invention are set forth in the attached detailed description and claims.

BRIEF DESCRIPTION OF THE FIGURES

FIG. 2 is an elevational view of the container for a beer keg and the like of the present invention with the lid on.

DESCRIPTION OF THE PREFERRED EMBODIMENT

Figure 1:
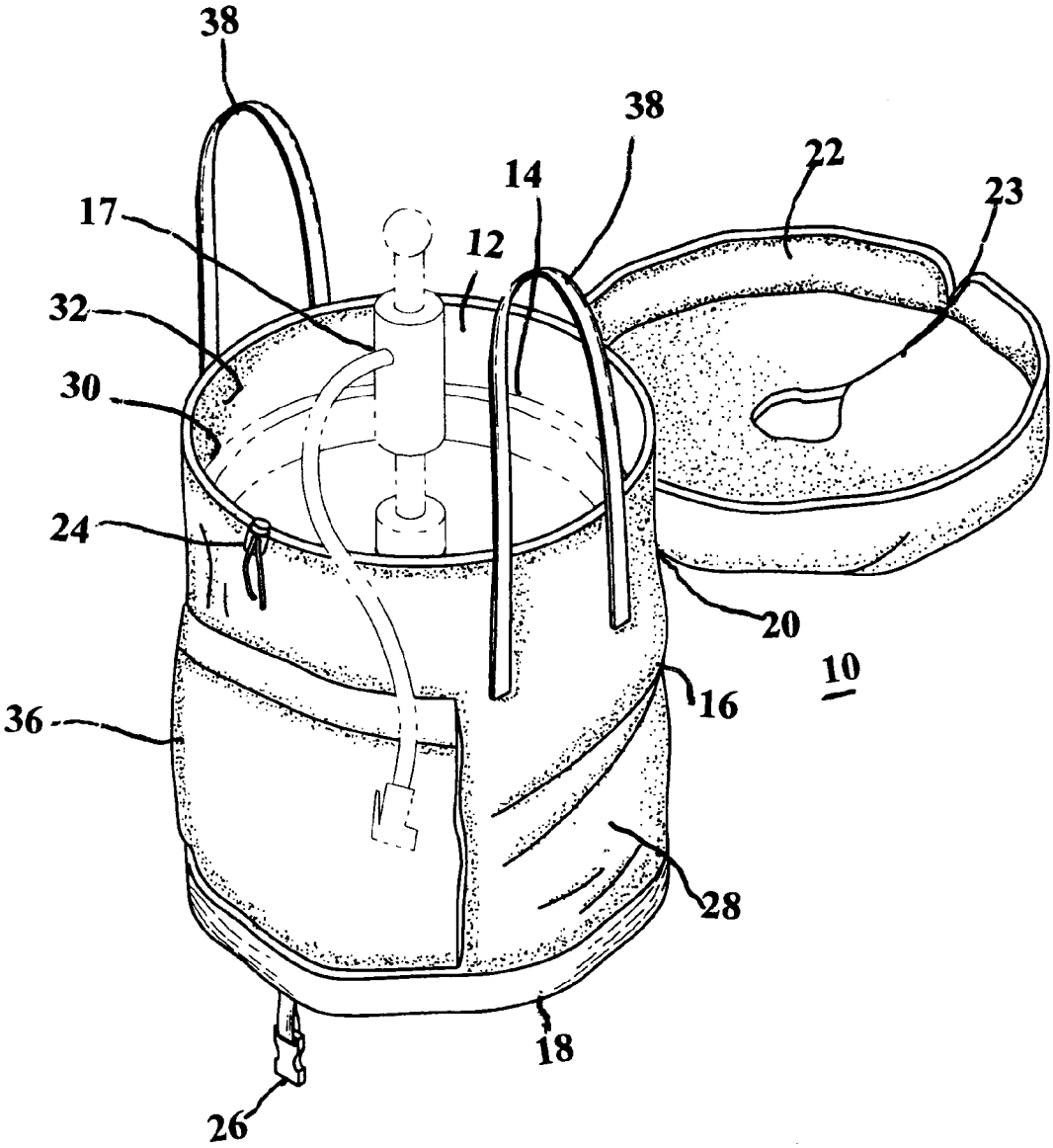
FIG. 1 is an elevational perspective view of the novel container for a beer keg and the like of the present invention.
Figure 3:
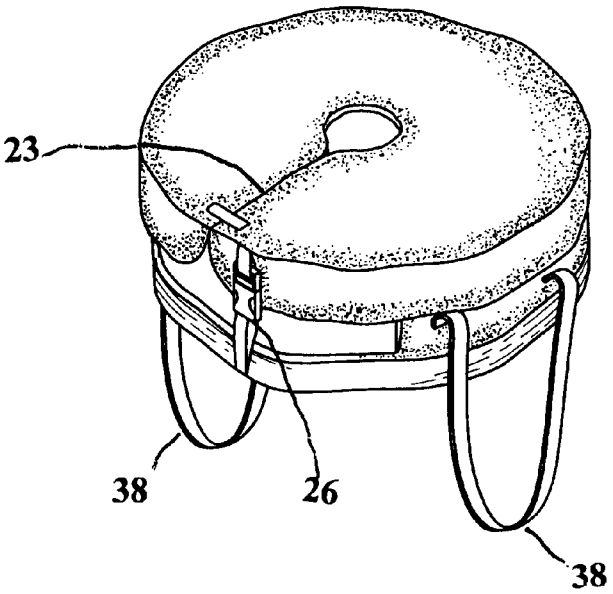
FIG. 3 is an elevational perspective view of the container for a beer keg and the like of the present invention with the lid in place and collapsed.
Figure 2:
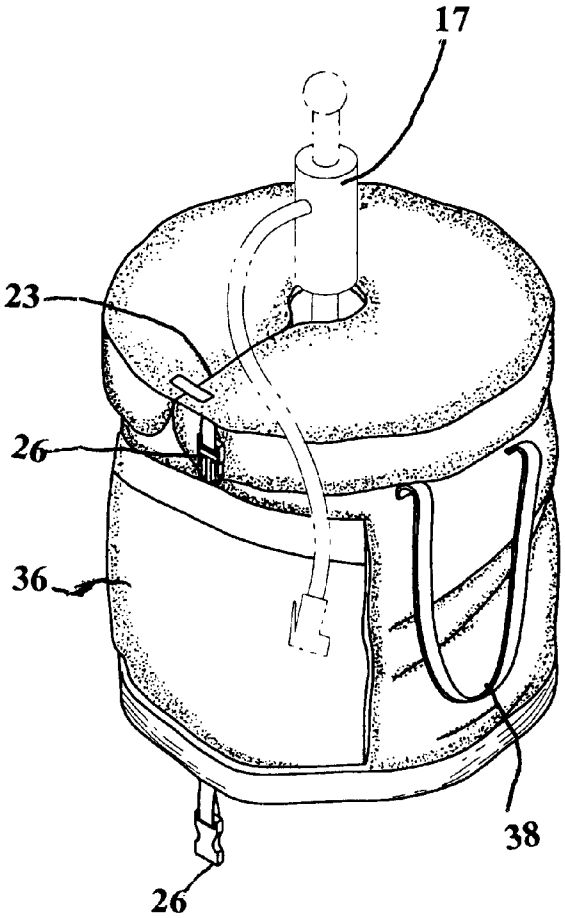
Figure 6:
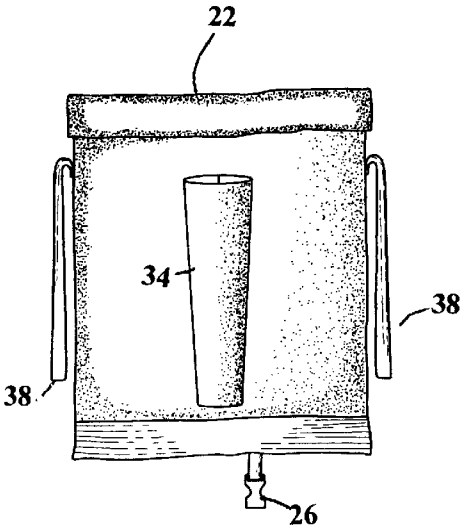
FIG. 6 is a side perspective view of the container for a beer keg and the like of the present invention.
Figure 5:
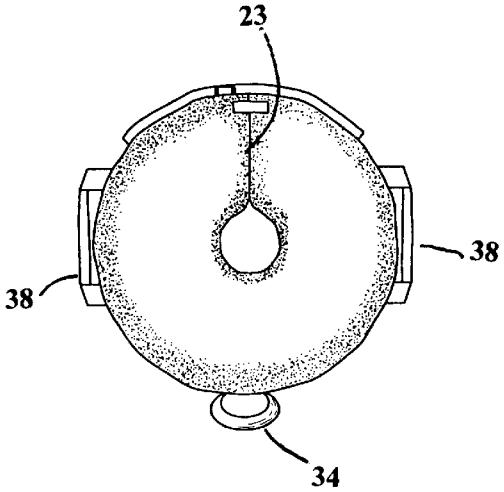
FIG. 5 is an overhead plan view of the container for a beer keg and the like of the present invention.
Figure 4:
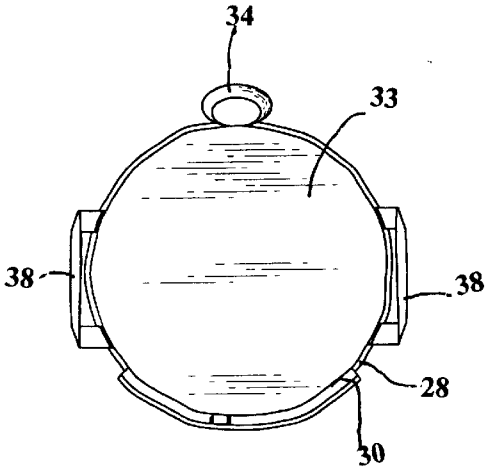
FIG. 4 is the underside view of the beer keg and the like of the present invention.
Figure 9:
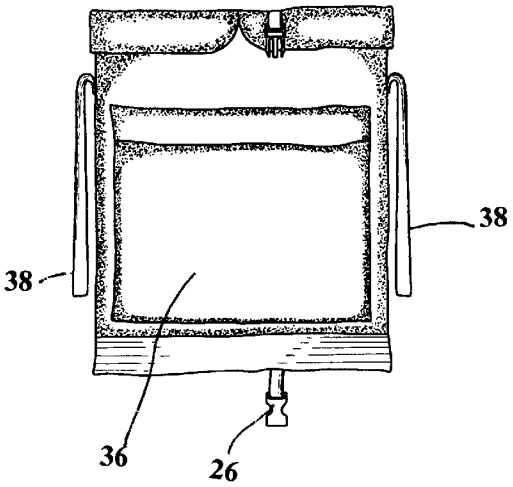
FIGS. 7–9 are further side perspective views of the container for a beer keg and the like of the present invention.
Figure 8:
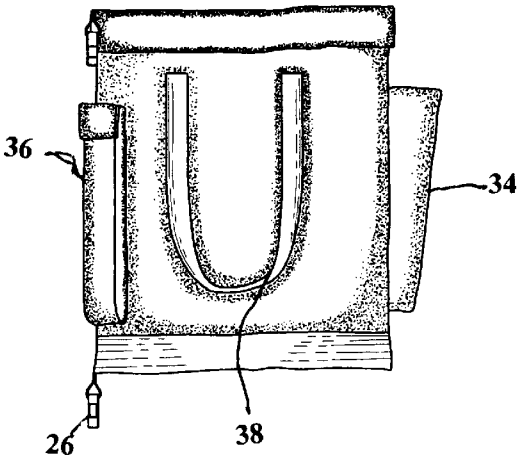
Figure 7:
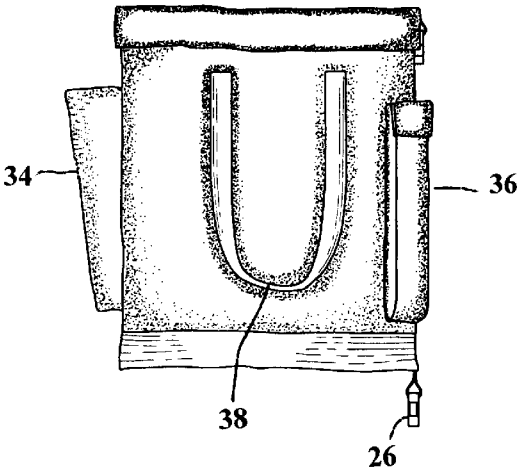

Referring now to FIGS. 1–9 a preferred embodiment of a thermally insulated keg container is shown and described. A keg container 10 has a cylindrical configuration defining a cylindrical internal compartment 12 in which to receive a beverage keg 14. The beverage keg 14 as discussed herein, for purposes of explanation and technical description, comprises a pre-chilled container containing a suitable beverage such as a soft drink, lemonade, beer, malt liquor, etc. to be dispensed by a rigid tap and hose 17.

The keg container 10 includes an annular body section 16 having an integral and sealed bottom end 18 and containing a flap 20 for supporting a removable or detachable lid 22. Lid 22 has a sealable flap 23 for ease of attachment over the tap 17. The container 10 may include a zipper (not shown) whereby the beverage keg 14 is completely enclosed. Alternatively, the container 10 may be closed via a snap 26 such that it may be collapsed as shown most particularly in FIG. 3. The top of the body section 16 includes a draw string 24 to completely close the container 10 about the keg tap 17.

Forming the body 16 and the lid 22 are spaced apart exterior cover 28 and interior cover 30, both of which are comprised of a flexible, tough, composition of synthetic material which may have been stitched at various seams into the relationship shown. In a preferred embodiment, both the exterior and interior covers, 28, 30 are comprised of a one thousand (1000) denier polyester reinforced vinyl that promotes high level durability and long life expectancy for the use and able to support and withstand scuffing normally encountered with such devices. Between the covers 28, 30 throughout is provided, a heavy weight twenty (20) ounce polyester thermal insulation 31 available, for example, under the trademark "Hollofill™" and generally formfit therein.

Internally, overlying the covers 28, 30 at the bottom is an added circular disc 33 of thermal insulation of a more rigid composition able to support the weight of the beverage keg 14. In a preferred embodiment, the disc 33 is comprised of a one (1) inch thick material, medium density foam board available under the mark "Ethiform™".

Further included within the compartment is a formfit liner of heat-sealed water impervious layer 32 to retain ice and water. The composition of the liner 32 is selected for toughness properties able to withstand suseptibility to tearing that could otherwise be encountered from movement or a sharp edge of the beverage keg 14 in the compartment 12.

The exterior of the device has affixed thereto a sleeve 34 for supporting cups and a storage pouch 36. The container 10 further includes handles 38 which wrap around and support the bottom 18 of the container.

The present invention has been described with reference to the enclosed figures, and it is to be appreciated that other embodiments fulfill the scope of the present invention and that the true nature and scope of the present invention is to be determined with reference to the claims appended hereto.

What is claimed is:

1. A thermally insulated portable container for carrying and storing a beverage keg, comprising:

a cylindrical body section having an open upper end, an inner layer, and an outer layer, said inner layer defining an internal cavity, said body section being movable between an extended position, in which said internal cavity is sized and shaped to receive the beverage keg, and a collapsed position, in which said body section is compacted for storage while empty;

a flexible thermal insulating material disposed between said inner layer and said outer layer;

a circular bottom wall integrally formed with said body section;

a support member positioned adjacent said bottom wall and adapted to support a bottom end of the beverage keg, said support member being formed from a relatively rigid thermal insulating material;

handle means attached to said outer layer, said container being liftable via said handle means;

a thermally insulated lid hingedly attached to said upper end of said body section, said lid being movable between an open position, in which said internal cavity is accessible, and a closed position, in which said upper end is closed by said lid;

fastening means for releasably fastening said lid in said closed position and for securing said container in said collapsed position, said fastening means being attached to said lid and said body section; and a cup sleeve attached to said outer layer, said cup sleeve being a pocket completely external to said body section.

2. A thermally insulated portable container according to claim 1, wherein said flexible thermal insulating material is a heavy weight polyester thermal insulation.

3. A thermally insulated portable container according to claim 1, wherein the heavy weight polyester thermal insulation is twenty ounce insulation.

4. A thermally insulated portable container according to claim 1, wherein said lid includes a sealable flap for moving said lid into said closed position while a tap is connected to the beverage keg.

* * * * *